US008443713B2

(12) United States Patent
Ogawa et al.

(10) Patent No.: US 8,443,713 B2
(45) Date of Patent: May 21, 2013

(54) ROTARY CYLINDER DEVICE

(75) Inventors: Hiroshi Ogawa, Sayama (JP); Fumito Komatsu, Shiojiri (JP)

(73) Assignees: Ikiken Co., Ltd., Sayama (JP); Yugen Kaisha K. R & D, Shiojiri (JP)

( * ) Notice: Subject to any disclaimer, the term of this patent is extended or adjusted under 35 U.S.C. 154(b) by 0 days.

(21) Appl. No.: 13/579,616

(22) PCT Filed: Feb. 1, 2011

(86) PCT No.: PCT/JP2011/052057

§ 371 (c)(1),
(2), (4) Date: Aug. 17, 2012

(87) PCT Pub. No.: WO2011/114786

PCT Pub. Date: Sep. 22, 2011

(65) Prior Publication Data

US 2012/0315176 A1 Dec. 13, 2012

(30) Foreign Application Priority Data

Mar. 16, 2010 (JP) ..... 2010-059901

(51) Int. Cl.
*F01B 9/00* (2006.01)
*F01B 1/00* (2006.01)

(52) U.S. Cl.
USPC ..... 92/138; 92/72; 92/146; 91/493

(58) Field of Classification Search
USPC ... 92/68, 72, 129, 138, 146, 147, 161; 91/493
See application file for complete search history.

(56) References Cited

U.S. PATENT DOCUMENTS

| | | | | |
|---|---|---|---|---|
| 2,683,422 | A * | 7/1954 | Richards, Jr. | 91/493 |
| 2012/0177524 | A1 * | 7/2012 | Komatsu | 418/161 |

FOREIGN PATENT DOCUMENTS

| | | | | |
|---|---|---|---|---|
| JP | 56-141079 | A | | 11/1981 |
| JP | 56141079 | A | * | 11/1981 |
| JP | 60-167812 | U | | 11/1985 |
| JP | 8-303254 | A | | 11/1996 |
| JP | 2000-97232 | A | | 4/2000 |
| JP | 2000-249047 | A | | 9/2000 |
| JP | 2002-276829 | A | | 9/2002 |
| JP | 2004-190613 | A | | 7/2004 |
| JP | 2006-22796 | A | | 1/2006 |
| JP | 2008-31908 | A | | 2/2008 |
| JP | 2008-78409 | A | | 4/2008 |
| JP | 4553977 | B1 | | 9/2010 |
| WO | WO 9745657 | A1 | * | 12/1997 |

* cited by examiner

*Primary Examiner* — Michael Leslie
(74) *Attorney, Agent, or Firm* — Birch, Stewart, Kolasch & Birch, LLP

(57) ABSTRACT

Disclosed is a small rotary cylinder device wherein friction loss is reduced and energy is conserved by reducing effects of a reaction force applied from cylinders to pistons, which is incorporated in a piston composite body and which linearly reciprocates, the piston composite body being eccentrically connected to a first crank shaft rotating about a shaft. Guide bearings (1*c*) guide linear reciprocation of first and second piston assemblies (7, 8) attached to second tube bodies (6*b*), which are caused by rotating a first crank shaft (5) about a shaft (4) and rotating a piston composite body (P) about the first crank shaft (5), in the radial direction of a rolling circle of second imaginary crank shafts (14*a*, 14*b*), which has a radius 2r and which is centered at the shaft (4).

3 Claims, 9 Drawing Sheets

O
R
r
R1
R2
5
14a
14b
23
24
30

ROTARY CYLINDER DEVICE

FIELD OF TECHNOLOGY

The present invention relates to a rotary cylinder device in which rotation of a shaft and linear reciprocation of a piston in a cylinder can be interconverted, more concretely relates to a rotary cylinder device which can be applied to various types of drive devices, e.g., compressor, vacuum pump, fluid rotary machine, internal-combustion engine.

BACKGROUND OF TECHNOLOGY

Conventional power engines, e.g., compressor, vacuum pump, fluid rotary machine, employ a various types of drive devices: a swing piston type drive device in which a fluid is repeatedly sucked and discharged by reciprocation of a swing piston connected to a crank shaft; a scroll type drive device in which a fluid is repeatedly sucked and discharged by rotating a rotary scroll with respect to a fixed scroll; a rotary type drive device in which a fluid is repeatedly sucked and discharged by rotating rollers (see Patent Document 1); a screw type drive device; and a vane type drive device.

Especially, in a two-piston/four-head fluid pump, a length of a first arm, which connects a crank pin to a shaft, and a length of a second arm, which connects a piston to a crank pin, are equalized so as to reduce a length of a crank arm by half and double a stroke of the piston (See Patent Document 2).

PRIOR ART DOCUMENT

Patent Document

Patent Document 1: Japanese Laid-open Patent Publication No. 2004-190613; and

Patent Document 2: Japanese Laid-open Patent Publication No. 56-141079

SUMMARY OF THE INVENTION

Problems to be Solved by the Invention

The above described fluid pump disclosed in the Patent Document 2 will be explained with reference to FIGS. 12 and 13. A rotary cylinder device is shown in FIG. 12, and it includes: a first crank shaft 53 being rotated about a shaft 51 by a first imaginary crank arm 52 which has a radius r; a second imaginary crank shaft 54 being rotated about the first crank shaft 53 by a second imaginary crank arm 59 which has a radius r; and a first piston assembly 55 and a second piston assembly being capable of linearly reciprocating, with making hypocycloid trajectories, in a state where piston head sections 55*b* and 56*b*, which are provided to ends of piston main bodies 55*a* and 56*a*, are inserted in four cylinders 57. The first piston assembly 55 and the second piston assembly 56 are respectively slidably fitted to eccentric sliders, which rotate about the first crank shaft 53, so as to perform linear reciprocation.

FIG. 13 is a schematic view of the first piston assembly 55. By rotating the crank shaft 51, the first crank shaft 53 is rotated by the first imaginary crank arm 52, and the second imaginary crank shaft 54 is rotated by a second crank arm 59, which is rotated about the first crank shaft 53, so that the first piston assembly 55 linearly reciprocates along the hypocycloid trajectory. In FIG. 13, the first imaginary crank arm 52, which is capable of rotating 360° about the crank shaft 51, and the second imaginary crank arm 59, which is capable of rotating 360° about the first crank shaft 53, are respectively intersected with the first piston assembly 55 at 45°.

In this state, fluid pressure P is applied to the first piston assembly 55 (one of the piston head sections 55*b*). Then, a reaction force P corresponding to the fluid pressure P is generated in the rotational direction of the crank shaft 51, which is a drive shaft. If the reaction force P acts on the first crank shaft 53, counter forces P/2 against the external force P respectively act on the crank shaft 51 and the second imaginary crank shaft 54. In this state, the counter force P/2 perpendicularly acting on the crank shaft 51 does not influence the reciprocation of the first piston main body 55*a* (the crank shaft 51, which is the center of rotation, is rotatably held by, for example, a ball bearing), so counter forces P/4 are respectively applied from the cylinders 57 to the both piston head sections 55*b*. Sliding friction of the both sides is $(P/4)\times\mu\times2$, where $\mu$ is a frictional coefficient between an outer circumferential face of the piston head section 55*b* and a sliding face (inner face) 57*a* of the cylinder.

By the sliding friction between the piston head sections 55*b* and the sliding faces 57*a*, seal cups 61 of the piston head sections 55*b* will be damaged, sliding faces 57*a* of the cylinders 57 will be unevenly abraded and energy consumption will be increased by friction loss.

An object of the present invention is to provide a small rotary cylinder device, in which friction loss is reduced and energy is conserved by reducing effects of a reaction force applied from sliding faces of cylinders to piston head sections of piston assemblies, which are incorporated in a piston composite body and which linearly reciprocates, the piston composite body being eccentrically connected to a first crank shaft rotating about a shaft.

Means for Solving the Problems

To achieve the object, the present invention has following structures.

The rotary cylinder device, in which linear reciprocation of pistons in cylinders and rotation of a shaft can be interconverted, comprises: a first crank shaft being eccentrically connected to the shaft, the first crank shaft being rotated about the shaft by a first imaginary crank arm which has a radius r; a piston composite body having an eccentric tube body constituted by a first tube body, which is concentrically fitted to the first crank shaft, and second tube bodies, which are extended from the first tube body and whose axes are second imaginary crank shafts eccentrically disposed with respect to the axis of the first tube body, the piston composite body being rotated about the first crank shaft, by a second imaginary crank arm which has a radius r, in a state where piston assemblies are attached to the second tube bodies and intersected with each other; a first balance weight and a second balance weight being respectively attached to ends of the first crank shaft, to which the piston composite body is fitted, so as to produce a rotational balance between rotating parts around the shaft; a main body case rotatably holding the shaft and rotatably accommodating the first crank shaft, which is rotated about the shaft, the first and second balance weights and the piston composite body, which is rotated about the first crank shaft; and guide bearings being provided to the main body case, the guide bearings guiding the linear reciprocation of the piston assemblies attached to the second tube bodies, which are caused by rotating the first crank shaft about the shaft and rotating the piston composite body about the first crank shaft, in the radial direction of a rolling circle of the second imaginary crank shafts, which has a radius 2r and which is centered at the shaft.

In the present invention, the first imaginary crank arm is a part connecting axes of the shaft and the first crank shaft, so if the part has a function of a crank arm, an independent crank arm is not required. The second imaginary crank arm is a part connecting axes of the first crank shaft and the second imaginary crank shaft, so if the part has a structure having a function of a crank arm, an actual crank arm may be omitted. The second imaginary crank shaft is a rotational axis imaginarily existed, and an actual crank shaft may be omitted. Further, the piston assembly is an assembly in which sealing members, e.g., seal cups, seal cup retainers, piston rings, are integrally attached to the piston head sections.

In the rotary cylinder device, the guide bearings may be provided on the both sides of a piston main body of each of the piston assemblies attached to the second tube bodies and intersected with each other, so as to guide the linear reciprocation of each of the piston assemblies.

In the rotary cylinder device, the piston main body of each of the piston assemblies attached to the second tube bodies and intersected with each other may have a guide hole extended in the longitudinal direction, the guide bearings respectively contact inner wall faces of the corresponding guide holes so as to guide the linear reciprocation of each of the piston assemblies.

Effects of the Invention

In the rotary cylinder device of the present invention, when the first crank shaft is rotated about the shaft and the piston composite body is rotated about the first crank shaft, the guide bearings guide the linear reciprocation of the piston assemblies attached to the second tube bodies.

Therefore, the guide bearings receive and reduce reaction forces applied from sliding faces of the cylinders to piston head sections of the piston assemblies, which reciprocate in the cylinders, so that sliding friction between the piston head sections and the cylinders can be reduced and friction loss, which causes especially energy consumption of a driving source, can be reduced.

In case that the guide bearings are provided on the both sides of the piston main body of each of the piston assemblies attached to the second tube bodies and intersected with each other, so as to guide the linear reciprocation of each of the piston assemblies, a reaction force applied from a sliding face of the cylinder to the piston head section of each piston assembly is received by one of the guide bearings, so that sliding friction between the piston head section and the cylinder can be reduced.

In case that the piston main body of each of the piston assemblies attached to the second tube bodies and intersected with each other has the guide hole extended in the longitudinal direction, the guide bearings respectively contact the inner wall faces of the corresponding guide holes so as to guide the linear reciprocation of each of the piston assemblies, the reaction force applied from the sliding face of the cylinder to the piston head section of each piston assembly is received by a small number of the guide bearings, so that sliding friction between the piston head section and the cylinder can be reduced. Therefore, friction loss between the piston assemblies and the cylinders can be reduced, and electric energy consumption of a drive source can be reduced. Further, number of parts accommodated in the main body case can be reduced, so that the rotary cylinder device can be easily assembled and spaces in the main body case can be effectively used.

EMBODIMENTS OF THE INVENTION

Preferred embodiments of the present invention will now be described in detail with reference to the accompanying drawings.

Firstly, an embodiment of the rotary cylinder device, which is used, for example, as a compressor, will be explained with reference to FIG. 1-8L. In the rotary cylinder device, linear reciprocation of pistons, with respect to cylinders, is converted into rotation of a shaft, and vice versa.

Figure 1:
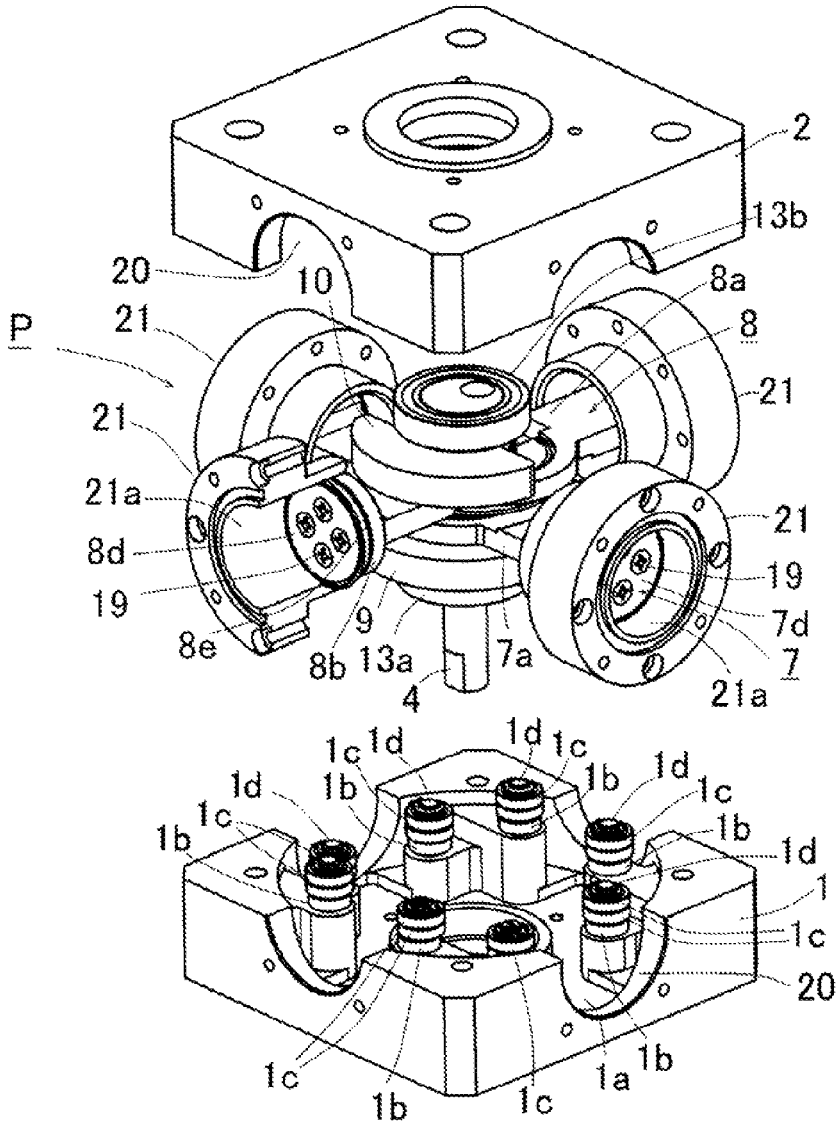
FIG. 1 is an exploded perspective view of a rotary cylinder device, in which a part of structural elements are partially cut away.
Figure 2:
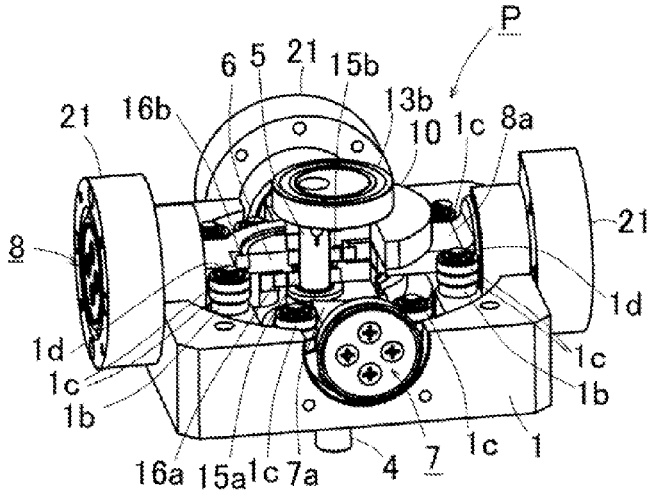
FIG. 2 is a perspective view of the rotary cylinder device shown in FIG. 1, in which a second main body case has been removed and a part of structural elements are partially cut away.

In FIG. 1, a shaft (input/output shaft) 4 is rotatably held in a main body case 3, which is constituted by a first main body case 1 and a second main body case 2. The first main body case 1 and the second main body case 2 are integrated, by bolts, not shown, at corners. As shown in FIG. 2, an eccentric tube body 6, which is capable of rotating about a first crank shaft 5, and a first and a second piston assemblies 7 and 8 (hereinafter referred to as "piston composite body P"), which are attached to the eccentric tube body 6 with bearings, are rotatably accommodated in the main body case 3. A concrete structure of the rotary cylinder device will be explained.

Figure 6:
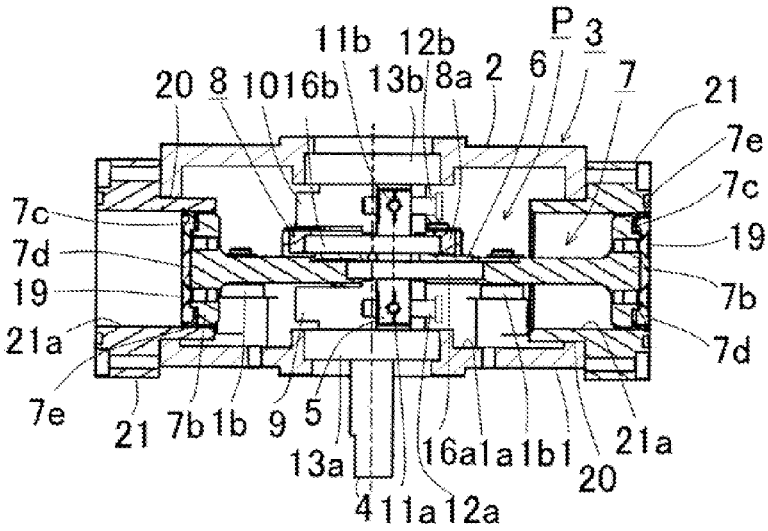
FIG. 6 is a sectional view taken a line A-A shown in FIG. 4.

In FIG. 6, the first crank shaft 5 is eccentrically connected to the shaft 4, with respect to an axial line thereof. In the present embodiment, the shaft 4 is integrated with a first balance weight 9. Note that, a shaft may be provided on the part of a second balance weight 10. The first and second balance weights 9 and 10 are fixed by bolts 12*a* and 12*b* which are respectively pierced through both end parts of the first crank shaft 5 (see FIG. 6).

In FIG. 6, the shaft 4 connected to the first balance weight 9 is rotatably held by a first bearing 13*a*, and a shaft section of the second balance weight 10 is rotatably held by a second bearing 13*b*. For example, the first and second balance weights 9 and 10 are formed into blocks (see FIG. 1), and they are attached to an outer circumference of the shaft 4 so as to produce a mass balance between rotatable members, including the first crank shaft 5 and the piston composite body P, which are rotated around the shaft 4.

Figure 7A:
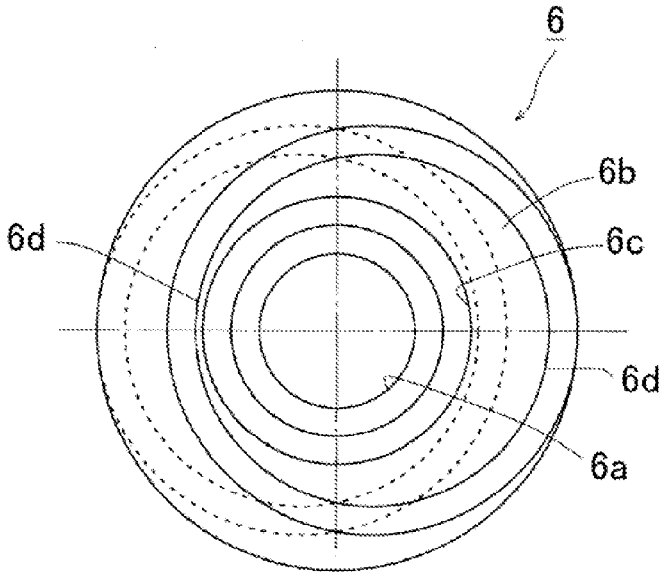
FIG. 7 includes FIG. 7A, which is a plan view seen from an axial direction of an eccentric tube body, and FIG. 7B, which is an axial sectional view.
Figure 7B:
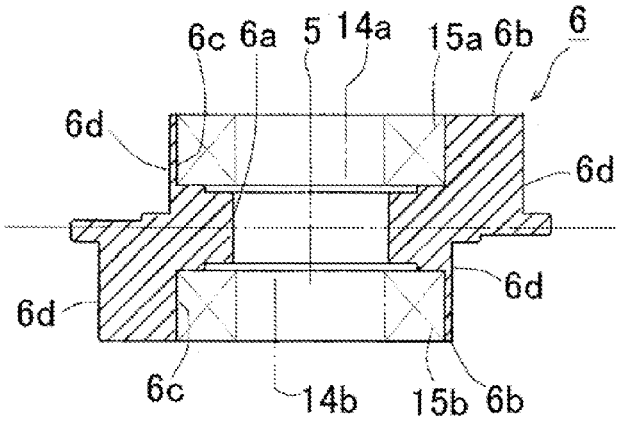

As shown in FIGS. 7A and 7B, the eccentric tube body 6 has a plurality of second imaginary crank shafts 14*a* and 14*b* whose axes are eccentrically disposed with respect to the axis of the first crank shaft 5. In the present embodiment, the two piston assemblies are intersected with each other, so the second imaginary crank shafts 14*a* and 14*b* are disposed, around the first crank shaft 5, with a phase difference of 180°.

The first and second piston assemblies 7 and 8 are attached to the eccentric tube body 6, arranged perpendicular to axes of the second imaginary crank shaft 14*a* and 14*b* and intersected with each other. In FIG. 7B, the eccentric tube body 6 includes: a first tube body 6*a*, through which the first crank shaft 5 acting as the rotational center is pierced; and second tube bodies 6*b* which are extended, from the first tube body 6*a*, to the both sides. The first crank shaft 5 is concentrically fitted in the first tube body 6*a* and acts as the rotational center of the eccentric tube body 6. The axes of the second tube bodies 6*b* correspond to the second imaginary crank shafts 14*a* and 14*b*, which are eccentrically disposed with respect to the axis of the first crank shaft 5 (the first tube body 6*a*). In FIGS. 7A and 7B, bearing retainer sections 6*c* and 6*d* are respectively formed in an inner circumference part and an outer circumference part of each of the second tube bodies 6*b*.

As shown in FIG. 7B, inner bearings 15*a* and 15*b* are retained by the inner bearing retainer sections 6*c*; as shown in FIG. 6, outer bearings 16*a* and 16*b* are retained by the outer bearing retainer sections 6*d*. The inner bearings 15*a* and 15*b* rotatably hold the first crank shaft 5. Further, the outer bearings 16*a* and 16*b* rotatably hold the first and second piston assemblies 7 and 8, which are fitted in the second tube bodies 6*b* and intersected with each other.

By the above described structure, a length of a second imaginary crank arm, which connects the first crank shaft 5 to the second imaginary crank shafts 14*a* and 14*b*, is defined according to a radius r of a rolling circle of the second tube body 6*b* (see FIGS. 8A-8L), so that the piston composite body P, which includes the eccentric tube body 6 centered at the first crank shaft 5, can be compactly attached in the axial direction and the radial direction.

In FIG. 6, first piston head sections 7*b* and second piston head sections 8*b* (not shown) are respectively provided to longitudinal ends of first and second piston main bodies 7*a* and 8*a*. In each of the first piston head sections 7*b* and the second piston head sections 8*b* (not shown), a ring-shaped seal cup 7*c* or 8*c* and a seal cup retainer 7*d* or 8*d* (not shown) are fixed by bolts 19. The seal cup 7*c* or 8*c* (not shown) is composed of an oil-free material, e.g., PEEK (polyether ether ketone) resin.

Figure 4:
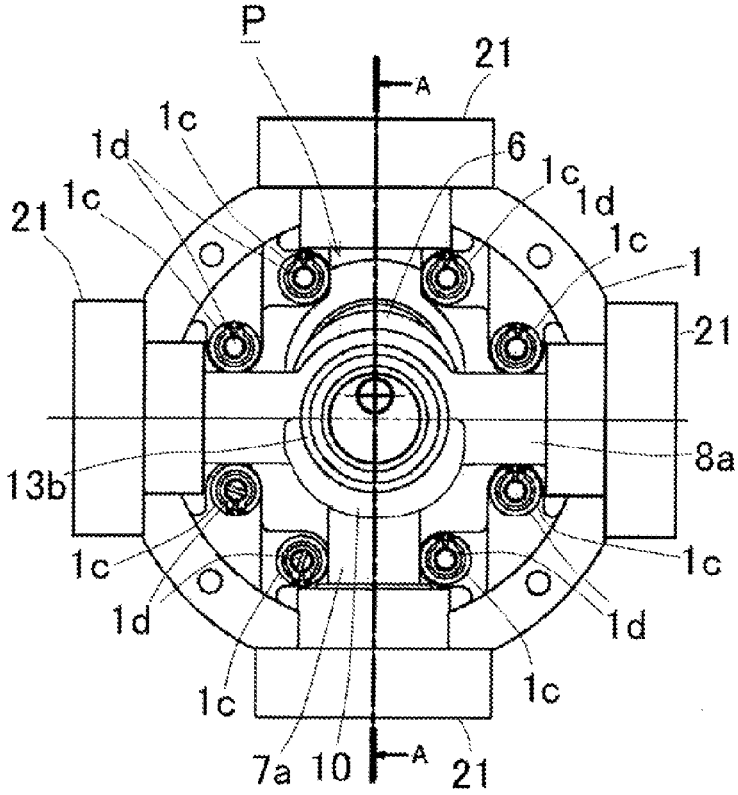
FIG. 4 is a plan view of the rotary cylinder device shown in FIG. 3.

In FIG. 4, cylinders 21 are respectively attached into opening sections 20, which are formed in side faces (four side faces) of the main body case 3 (the first main body case 1 and the second main body case 2). The first piston head sections 7*b* and the second piston head sections 8*b* are capable of sliding on inner faces 21*a* of the cylinders 21, and sealing ability between the both can be kept by the seal cups 7*c* and 8*c* (not shown). Erecting sections 7*e* (see FIG. 6) and 8*e* (see FIG. 1) are formed in outer circumferences of the seal cups 7*c* and 8*c*. In case of the compressor, the erecting sections 7*e* and 8*e* are faced outward in the sliding direction of the pistons (see FIG. 6).

As shown in FIG. 1, the first piston head sections 7*b* (see FIG. 6) and the second piston head sections 8*b* of the first piston main body 7*a* and the second piston main body 8*a* are capable of sliding on the inner faces 21*a* of the cylinders 21.

Figure 3:
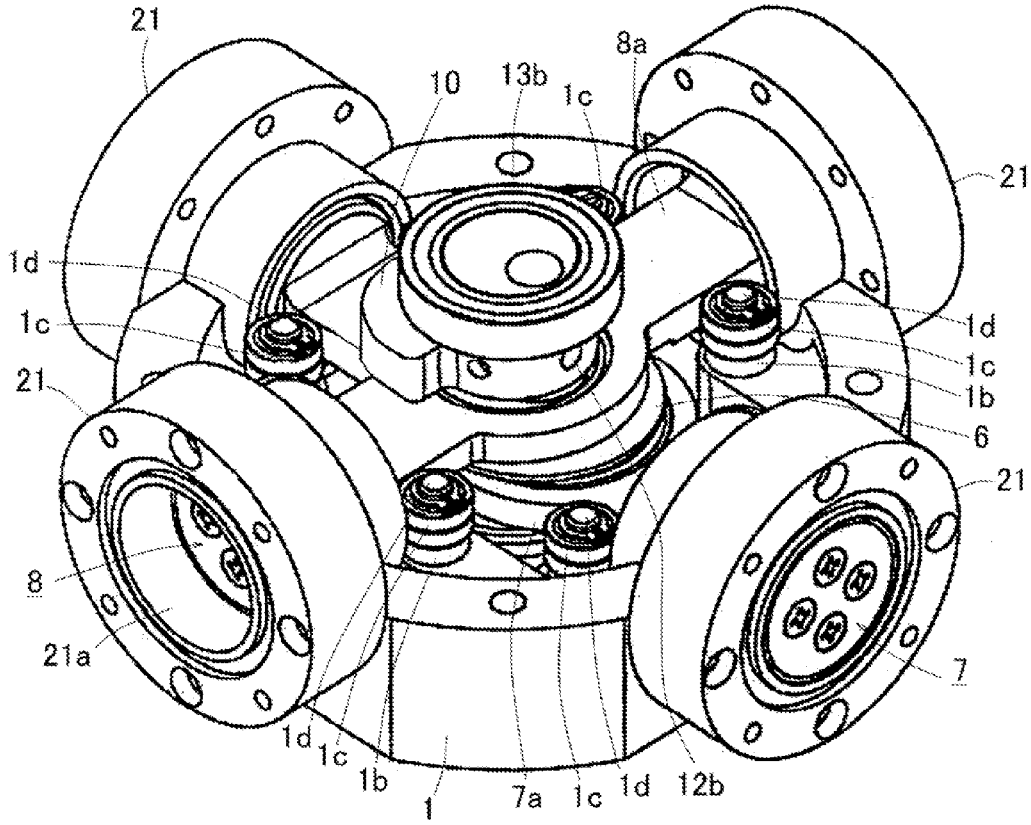
FIG. 3 is a perspective view of the rotary cylinder device, in which the second main body case has been removed.

In FIG. 1, eight boss sections 1*b* are formed in an inner bottom section 1*a* of the first main body case 1, and they are located close to the cylinders 21. Two guide bearings 1*c* are stacked at an axial end of each of the boss sections 1*b*, and the guide bearings 1*c* are retained by fitting pins 1*d* into an axial hole of each of the boss sections 1*b*. As shown in FIG. 3, the guide bearings 1*c* are disposed on the both sides of the first and second piston main bodies 7*a* and 8*a* of the first and second piston assemblies 7 and 8 so as to guide their linear reciprocation.

A relationship between the rotation of the first crank shaft 5 about the shaft 4, the rotation of the second imaginary crank shafts 14*a* and 14*b* and the linear reciprocation of the pistons (a hypocycloid movement system) will be explained with reference to FIGS. 8A-8L. In FIGS. 8A-8L, a center O of a rolling circle 23 corresponds to the axis of the shaft 4. The first crank shaft 5 is eccentrically shifted from the center O, and the second imaginary crank shafts 14*a* and 14*b* are rotated by rotating the first crank shaft 5. Number of the second imaginary crank shafts 14*a* and 14*b* corresponds to number of the pistons.

A length r between the axis of the shaft 4 (the center O) and the axis of the first crank shaft 5 is an arm length (a radius of rotation) of the first imaginary crank arm and the second imaginary crank arm. The first crank shaft 5 is rotated along a rotational orbit 30, whose center is the axis of the shaft 4 (the center O) and whose radius is equal to the arm length r of the first imaginary crank arm. Further, the second imaginary crank shafts 14*a* and 14 are apparently rotated along a rotational orbit (an imaginary circle 24), whose center is the first crank shaft 5 and whose radius is equal to the arm length r of the second imaginary crank arm. With this structure, the first and second piston assemblies 7 and 8 are reciprocated in the radial direction of a rolling circle 23, whose center is the center O and whose radius is equal to a diameter R (2r) of the imaginary circle 24.

Figures 8A, 8B, 8C, 8D, 8E, 8F, 8G, 8H, 8I, 8J, 8K, 8L:
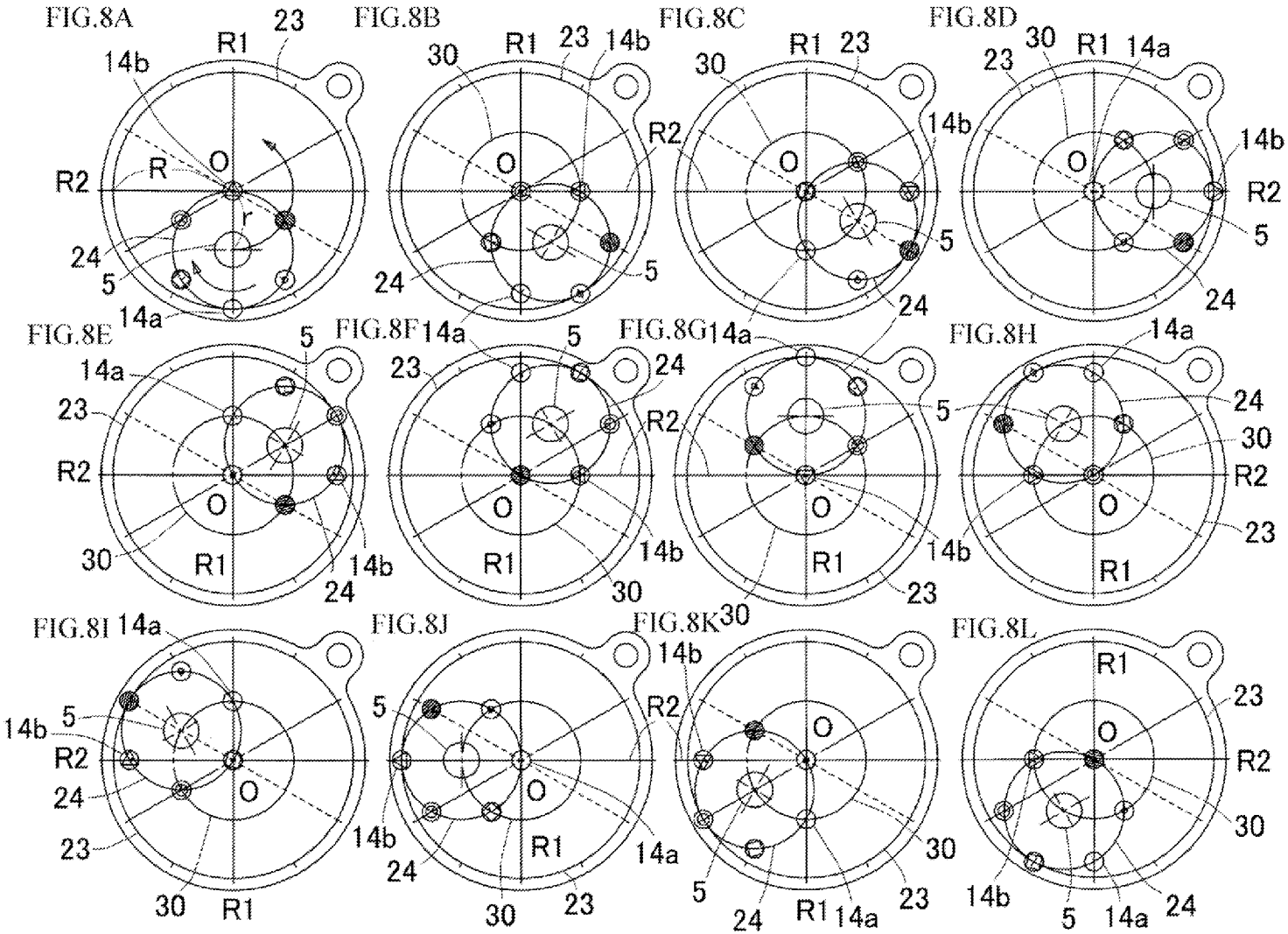
FIG. 8 includes FIGS. 8A-8L, each of which shows a rotational orbit of a first crank shaft around a shaft, a rotational orbit of a second imaginary crank shaft around the first crank shaft and linear reciprocation of piston assemblies.

In the present embodiment, the second imaginary crank shafts 14*a* and 14*b* of the second tube bodies 6*b*, to which the first and second piston assemblies 7 and 8 intersecting with each other are connected, are exemplified. In FIG. 8A, the second imaginary crank shaft 14*a* is located at a point (a lower end point) at the inter section of the rolling circle 23 with a diameter R1; the second imaginary crank shaft 14*b* is located at the center O (the axis of the shaft 4) of the rolling circle 23. The first crank shaft 5 is separated the distance r form the center O of the rolling circle 23.

A case of rotating the first crank shaft 5 around the center O of the rolling circle 23 in the counterclockwise direction will be explained. Note that, the imaginary circle 24 is rotated, in the clockwise direction, along the inner circumference of the rolling circle 23 without being slipped. In each of FIGS. 8A-8L, the position of the first crank shaft 5 is shifted 30° from the former state.

When the first crank shaft 5 is rotated 90°, in the counterclockwise direction, from the position shown in FIG. 8A, it locates at the position shown in FIG. 8D. During this operation, the second imaginary crank shaft 14*a* is moved, along the diameter R1 of the rolling circle 23, to the center O; the second imaginary crank shaft 14*b* is moved to a point (a right end point) at the intersection of a diameter R2, which is perpendicular to the diameter R1, with the rolling circle 23.

When the first crank shaft 5 is further rotated 90°, in the counterclockwise direction, from the position shown in FIG. 8D, it locates at the position shown in FIG. 8G. During this operation, the second imaginary crank shaft 14*a* is moved to a point (an upper end point) at the intersection of the diameter R1 with the rolling circle 23; the second imaginary crank shaft 14*b* is moved to the center O of the rolling circle 23.

When the first crank shaft 5 is further rotated 90°, in the counterclockwise direction, from the position shown in FIG. 8G, it locates at the position shown in FIG. 8J. During this operation, the second imaginary crank shaft 14*a* is moved to the center O of the rolling circle 23; the second imaginary crank shaft 14*b* is moved to a point (a left end point) at the intersection of the diameter R2 with the rolling circle 23.

When the first crank shaft 5 is further rotated 90°, in the counterclockwise direction, from the position shown in FIG. 8J, it locates at the position shown in FIG. 8A. During this operation, the second imaginary crank shaft 14*a* is moved to the point (the lower end point) at the intersection of the diameter R1 with the rolling circle 23; the second imaginary crank shaft 14*b* is moved to the center O of the rolling circle 23.

As described above, by rotating the first crank shaft 5 around the center O (the shaft 4), the second imaginary crank shaft 14*a* reciprocates along the diameter R1 of the rolling circle 23, which is a rolling track of the imaginary circle 24; the second imaginary crank shaft 14*b* reciprocates along the diameter R2 of the rolling circle 23.

Namely, the first crank shaft 5 and the piston composite body P (see FIG. 2) are rotated along the rotational orbit 30 which is formed around the axis of the shaft 4 (the center O), so that the first piston assembly 7, which is connected to the eccentric tube body 6 at one of the second tube bodies 6*b* whose axes correspond to the second imaginary crank shafts 14*a* and 14*b*, is repeatedly reciprocated along the diameter R1 of the rolling circle 23 (the circle centered at the axis of the shaft 4) which has the radius 2r, and the second piston assembly 8 is repeatedly reciprocated along the on the diameter R2 of the rolling circle 23 (the circle centered at the axis of the shaft 4) which has the radius 2r.

FIG. 6 shows an example of the structure of the rotary cylinder device.

The inner bearings 15*a* and 15*b* are attached to the bearing retainer sections 6*c* of the eccentric tube body 6 (see FIG. 7B). Further, the first crank shaft 5 is fitted into center holes of the inner bearings 15*a* and 15*b*, which are attached to the eccentric tube body 6, and the first tube body 6*a*. The seal cups 7*c* and 8*c* and the seal cup retainers 7*d* and 8*d* are attached to the first and second piston head sections 7*b* and 8*b* of the first and second piston main bodies 7*a* and 8*a* by the bolts 19. The first and second piston assemblies 7 and 8 are attached so as to fit the outer bearings 16*a* and 16*b*. The first and second piston assemblies 7 and 8 are fitted into the second tube bodies 6*b*, with the outer bearings 16*a* and 16*b*, and intersected with each other.

The first and second balance weights 9 and 10 are respectively fitted to the ends of the first crank shaft 5, and pins 11*a* and 11*b* are fitted into pin-holes and screwed with bolts 12*a* and 12*b*, so that the first and second balance weights 9 and 10 can be integrated with the first crank shaft 5. The first bearing 13*a* is fitted to the first main body case 1, and the second bearing 13*b* is fitted to the second main body case 2. The guide bearings 1*c* are respectively attached to the boss sections 1*b*, which are projected from the inner bottom section 1*a* of the first main body case 1. The shaft 4 is fitted into the first bearing 13*a*, the shaft part of the balance weight 10 is fitted into the second bearing 13*b*, and the first main body case 1 and the second main body case 2 are integrated by the bolts. Therefore, the first and second piston assemblies 7 and 8 (the piston composite body P, see FIG. 1), which have been attached to the eccentric tube body 6 and intersected with each other, can be accommodated in the main body case 3. Finally, the cylinders 21 are attached into the opening sections 20 formed in the side faces (the four side faces) of the main body case 3, and the first piston head sections 7*b* and the second piston head sections 8*b* are slidably fitted in the inner faces 21*a* of the cylinders 21 (see FIG. 1), so that the rotary cylinder device can be completely assembled.

Figure 5:
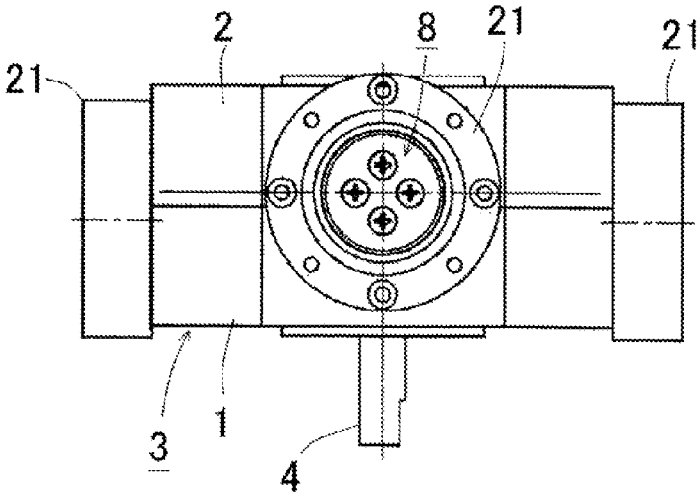
FIG. 5 is a left side view.

In FIG. 5, the first piston assembly 7 and the second piston assembly 8 are attached to the eccentric tube body 6 in a state where their axes are slightly shifted in the axial direction of the shaft 4. However, the axes of the first piston main body 7*a* and the outer bearing 16*a* are corresponded to each other and the axes of the second piston main body 8*a* and the outer bearing 16*b* are corresponded to each other (see FIG. 6), so even if the eccentric tube body 6 is rotated about the first crank shaft 5, rotational vibration can be restrained. Small plays (about 30 μm to 50 μm), which are formed by machining errors, will exist between the first and second piston head sections 7*b* and 8*b* and the inner faces 21*a* of the cylinders 21 and vibration will be generated in the small plays, but the vibration can be absorbed by the erecting sections 7*e* and 8*e* of the seal cups 7*c* and 8*c*, which are inserted into gaps between the first and second piston head sections 7*b* and 8*b* and the inner faces 21*a* of the cylinders 21 (see FIG. 6), so that generating noise can be prevented.

In the rotary cylinder device assembled as described above, a first rotational balance of the first and second piston assemblies 7 and 8 around the second imaginary crank shafts 14*a* and 14*b*, a second rotational balance of the piston composite body P around the first crank shaft 5 and a third rotational balance of the first crank shaft 5 and the piston composite body P around the shaft 4 are well produced by the first and second balance weights 9 and 10.

With the above described structure, even if the first and second piston assemblies 7 and 8, which are attached to the second tube bodies 6*b*, are linearly reciprocated in the radial directions of the rolling circle 23 of the second imaginary crank shafts 14*a* and 14*b*, which has the radium 2r and which is centered at the shaft 4, rotational vibration can be restrained, generating noise can be prevented, mechanical loss can be reduced, and energy converting efficiency can be increased by reducing the vibration caused by the rotation about the shaft 4.

In FIG. 4, the first and second piston assemblies 7 and 8, which are attached to the second tube bodies 6*b*, are linearly reciprocated by rotating the first crank shaft 5 about the shaft 4 and rotating the piston composite body P about the first crank shaft 5, and the guide bearings 1*c* guide the linear reciprocation in the radial directions of the rolling circle of the second imaginary crank shafts 14*a* and 14*b*, which has the radius 2r and which is centered at the shaft 4.

Figure 13:
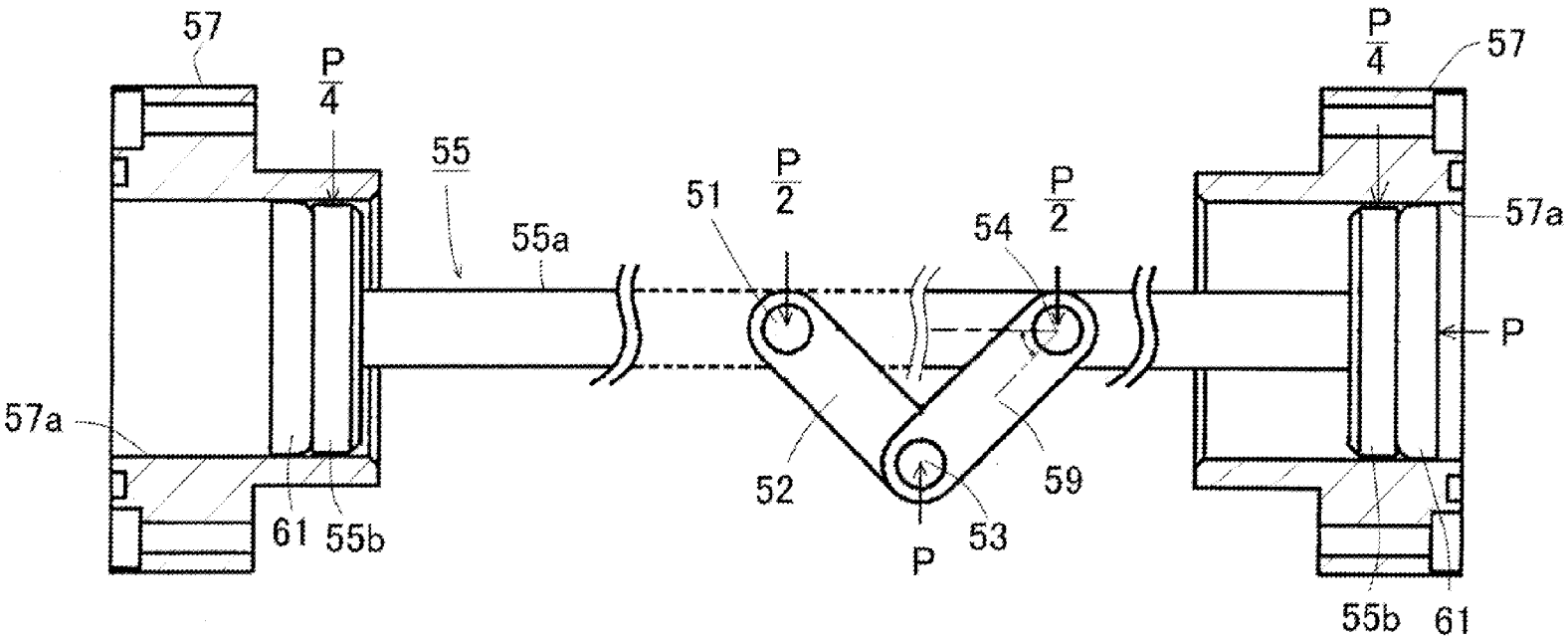
FIG.13 PRIOR ART
FIG. 13 is a schematic view showing external forces applied to the piston assembly and the cylinders.

During the above described operation, the reaction forces (P/4 shown in FIG. 13) applied from the sliding faces of the cylinders to the first and second piston head sections 7*b* and 8*b* of the first and second piston assemblies 7 and 8 are received by the guide bearings 1*c* on one side, and slide resistance between the first and second piston head sections 7*b* and 8*b* and the cylinders 21 can be reduced. Therefore, friction loss between the first and second piston assemblies 7 and 8 and the cylinders 21 can be reduced, and energy consumption of a drive source can be reduced.

Note that, gaps between the first and second piston main bodies 7*a* and 8*a* and the guide bearings 1*c*, which receive lateral pressure therefrom, are minimized, in consideration of machining errors and thermal dimension change of parts, so as not to cause mechanical interference.

In the present embodiment, the first and second piston assemblies 7 and 8 are intersected at the right angle, but the arrangement of the both is not limited to the above described embodiment, so they may be arranged around the first crank shaft 5 with a phase difference of, for example, 60°.

Next, another structure of the guide bearings will be explained with reference to FIGS. 9-11.

Figure 9:
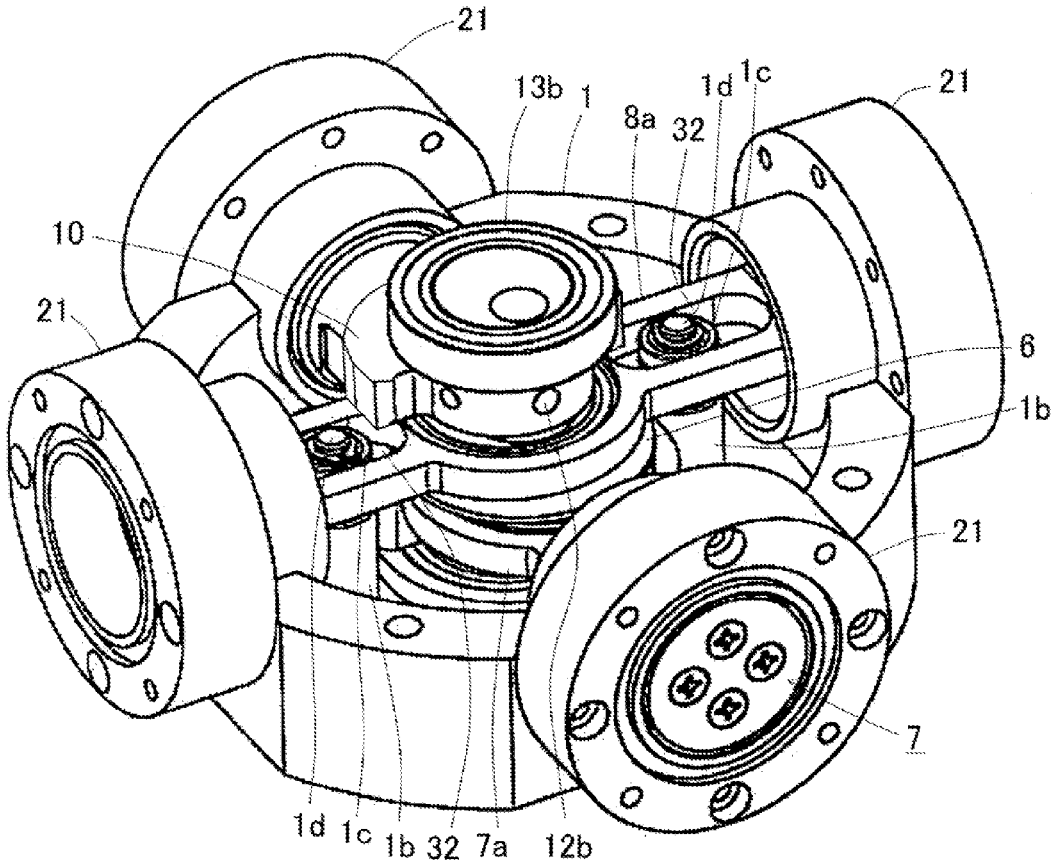
FIG. 9 is a perspective view of another rotary cylinder device, in which the second main body case has been removed.

As shown in FIG. 9, in the first and second piston assemblies 7 and 8, guide holes (long holes) 31 and 32 are respectively formed in the first and second piston main bodies 7*a* and 8*a*. As shown in FIG. 11, the four boss sections 1*b* are projected, in the inner bottom section 1*a* of the first main body case 1, at the positions corresponding to the guide holes 31 and 32. The two guide bearings 1*c* are stacked at the end of each of the boss sections 1*b*, and the guide bearings 1*c* are connected to each of the boss sections 1*b* by fitting the fitting pin 1*d* into the axial hole of each of the boss sections 1*b*. In FIG. 10, the guide bearings 1*c* are respectively fitted into the guide holes 31 and 32 so as to guide the linear reciprocation of the first and second piston assemblies 7 and 8, which are attached to the second tube bodies 6*b*, at positions where guide bearings are overlapped with the first and second piston main bodies 7*a* and 8*a*.

Figure 10:
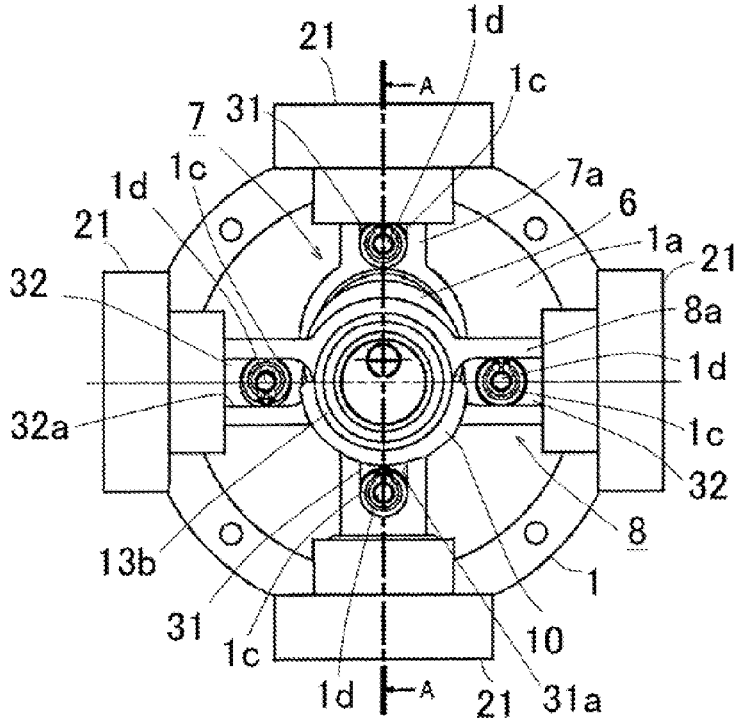
FIG. 10 is a plan view of the rotary cylinder device shown in FIG. 9.
Figure 11:
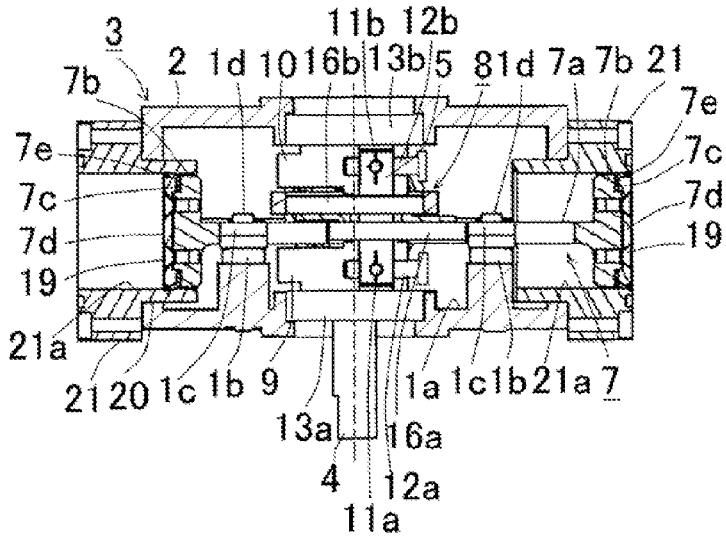
FIG. 11 is a sectional view taken a line A-A shown in FIG. 9.
Figure 12:
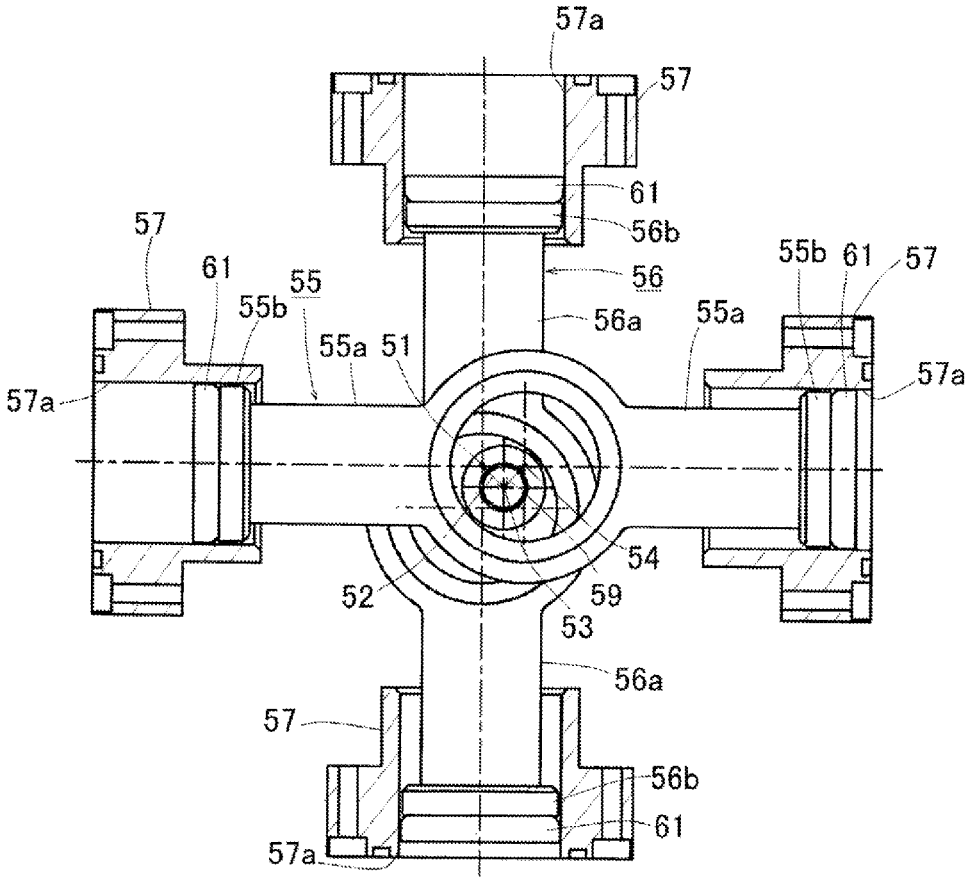
FIG.12 PRIOR ART
FIG. 12 is an explanation view showing arrangement of a first piston assembly, a second piston assembly and cylinders.

As shown in FIG. 10, the guide bearings 1*c* contact inner wall faces 31*a* and 32*a* of the guide holes 31 and 32 so as to guide the linear reciprocation of the first and second piston assemblies 7 and 8. With this structure, the reaction forces applied from the sliding faces of the cylinders to the first and second piston head sections 7*b* and 8*b* of the first and second piston assemblies 7 and 8 are received by a small number of the guide bearings 1*c* (e.g., four guide bearings), so that the slide resistance between the first and second piston head sections 7*b* and 8*b* and the cylinders 21 can be reduced. Therefore, the friction loss between the piston assemblies and the cylinders (see P/4 shown in FIG. 13) can be reduced, and energy consumption of the drive source can be reduced. Further, number of the parts in the main body case 3 can be reduced, so that the rotary cylinder device can be easily assembled and spaces in the main body case 3 can be effectively used.

Note that, various types of bearings, e.g., rolling bearing, slide bearing, metal bearing, can be used as the guide bearing 1*c*.

Further, the guide bearings 1*c* are provided to the first main body case 1, but they may be provided to the second main body case 2 or may be provided to the both of the first and second main body cases 1 and 2.

What is claimed is:

1. A rotary cylinder device, in which linear reciprocation of pistons in cylinders and rotation of a shaft can be interconverted, comprising:

a first crank shaft being eccentrically connected to the shaft, the first crank shaft being rotated about the shaft by a first imaginary crank arm which has a radius (r);

a piston composite body having an eccentric tube body constituted by a first tube body, which is concentrically fitted to the first crank shaft, and second tube bodies, which are extended from the first tube body and whose axes are second imaginary crank shafts eccentrically disposed with respect to the axis of the first tube body, the piston composite body being rotated about the first crank shaft, by a second imaginary crank arm which has a radius (r), in a state where piston assemblies are attached to the second tube bodies and intersected with each other;

a first balance weight and a second balance weight being respectively attached to ends of the first crank shaft, to which the piston composite body is fitted, so as to produce a rotational balance between rotating parts around the shaft;

a main body case rotatably holding the shaft and rotatably accommodating the first crank shaft, which is rotated about the shaft, the first and second balance weights and the piston composite body, which is rotated about the first crank shaft; and guide bearings guiding the linear reciprocation of the piston assemblies attached to the second tube bodies, which are caused by rotating the first crank shaft about the shaft and rotating the piston composite body about the first crank shaft, in the radial direction of a rolling circle of the second imaginary crank shafts, which has a radius (2r) and which is centered at the shaft, wherein the first crank shaft is rotated about the shaft and the piston composite body is rotated about the first crank shaft in a state where mass balances of a first rotational balance relating to the piston assemblies around the second imaginary crank shafts, a second rotational balance relating to the piston composite body around the first crank shaft and a third rotational balance relating to the first crank shaft and the piston composite body around the shaft are equally balanced by only the first and second balance weights which are attached to both ends of the first crank shaft, thereby the piston assemblies, which are attached to the second tube bodies, are relatively rotated about the shaft, and their linear reciprocation in the cylinders are guided by the guide bearings.

2. The rotary cylinder device according to claim 1, wherein the guide bearings are provided on the both sides of a piston main body of each of the piston assemblies attached to the second tube bodies and intersected with each other, so as to guide the linear reciprocation of each of the piston assemblies.

3. The rotary cylinder device according to claim 1, wherein the piston main body of each of the piston assemblies attached to the second tube bodies and intersected with each other has a guide hole extended in the longitudinal direction, the guide bearings respectively contact inner wall faces of the corresponding guide holes so as to guide the linear reciprocation of each of the piston assemblies.

* * * * *